United States Patent [19]

Browder

[11] Patent Number: 4,967,428

[45] Date of Patent: Nov. 6, 1990

[54] CHILD'S RESTING MAT ORGANIZATION

[76] Inventor: Mary S. Browder, Rt. 2 Reagan Station, Sweetwater, Tenn. 37874

[21] Appl. No.: 439,156

[22] Filed: Nov. 20, 1989

[51] Int. Cl.[5] ..... A47G 9/06

[52] U.S. Cl. ..... 5/419; 5/420; 5/465

[58] Field of Search ..... 5/419, 420, 465, 437, 5/439

[56] References Cited

U.S. PATENT DOCUMENTS

| | | | |
|---|---|---|---|
| 1,256,783 | 2/1918 | Fuller | 5/419 |
| 1,930,942 | 10/1933 | Pringle | 5/419 |
| 2,788,533 | 4/1957 | Bornstein | 5/420 |
| 2,898,609 | 8/1959 | Storie | 5/419 |
| 3,336,610 | 8/1967 | Geddings | 5/420 |
| 3,689,947 | 9/1972 | Wolf | 5/419 |
| 4,097,944 | 7/1978 | Yulish | 5/419 |
| 4,101,994 | 7/1978 | Hoyt | 5/419 |
| 4,195,378 | 4/1980 | Parker | 5/419 |
| 4,256,096 | 3/1981 | Budde | 5/465 X |
| 4,382,306 | 5/1983 | Lickert | 5/465 |
| 4,466,516 | 8/1984 | Sicoli et al. | 5/419 X |
| 4,601,076 | 7/1986 | Knobeloch | 5/420 X |
| 4,796,734 | 1/1989 | Distasio | 5/418 X |
| 4,802,249 | 2/1989 | Bills | 5/465 |
| 4,843,662 | 7/1989 | Handelman | 5/420 X |

FOREIGN PATENT DOCUMENTS

| | | | |
|---|---|---|---|
| 404796 | 10/1968 | Australia | 5/420 |

*Primary Examiner*—Eric K. Nicholson
*Attorney, Agent, or Firm*—Leon Gilden

[57] ABSTRACT

A resting mat for use particularly by children to effect compact portage and use as desired. The organization provides a character configured pillow, particularly in the shape of an animal to enhance a child's use of the device, wherein the pillow is secured to an external hook and loop fastener strip during portage with securement straps oriented about a covering to maintain interfolding of the organization during transport thereof and enable convenient and rapid extension of the organization with repositioning of the pillow to a further hook and loop fastener strip during use.

5 Claims, 1 Drawing Sheet

CHILD'S RESTING MAT ORGANIZATION

BACKGROUND OF THE INVENTION

1. Field of the Invention

The field of invention relates to resting and sleeping mattress organizations, and more particularly pertains to a new and improved child's resting mat organization wherein the same is arranged for convenient interfolded transport and subsequent extended orientation of the device for use.

2. Description of the Prior Art

Individuals, and particularly children, are frequently reluctant to accept varying forms for sleep and accordingly, the prior art has provided various apparatus and organizations to enhance a child's acceptance of a strange and varied form for nocturnal resting. The instant invention provides a convenient and portable child's resting mat utilizing a psychologically soothing pillow organization in coordination with the organization to induce a child's use thereof. Examples of the prior art include U.S. Pat. No. 1,256,783 to Fuller setting forth a mat organization including strap members and an integrally associated pillow for enabling transport of the organization subsequent to its use.

U.S. Pat. No. 1,930,942 to Pringle sets forth sleeping equipment utilizing an integral strap secured to the organization permitting an unpacking and expeditious repacking of the unit as desired.

U.S. Pat. No. 2,788,533 to Bornstein provides for an interfoldable compartmentalized mattress provided with medially positioned handles on edge portions thereof for transport of the unit.

U.S. Pat. No. 4,097,944 to Yulish sets forth a beach mat provided with an enclosed pillow at a central portion of an end member stitched to the organization with securement straps at a remote end of the organization to enable securement of the device when not in use.

U.S. Pat. No. 3,689,947 to Wolf sets forth a towel member combined with a pillow wherein in a beach environment an individual may utilize the pillow in an inflated posture for reclining thereon.

As such, it may be appreciated that there is a continuing need for a new and improved child's resting mat organization wherein the same addresses both the problems of ease of use and acceptance by a child, and in this respect, the present invention substantially fulfills this need.

SUMMARY OF THE INVENTION

In view of the foregoing disadvantages inherent in the known types of mat organization now present in the prior art, the present invention provides a child's resting mat organization wherein the same provides a unitary interfoldable mat portion and a selectively securable pillow transportable with the organization in an interfolded orientation to enable ease of transport and subsequent use thereof. As such, the general purpose of the present invention, which will be described subsequently in greater detail, is to provide a new and improved child's resting mat organization which has all the advantages of the prior art mat organizations and none of the disadvantages.

To attain this, the child's resting mat organization includes a central polymeric sponge-like central mattress enveloped by a removable and washable covering to enable washing and sanitizing of the cover. The cover is provided with hook and loop fastener strips and strap members formed with hook and loop fastener elements thereon to secure the cover about the central foam core and interfold the mattress core and covering in an accordion like manner, wherein the straps are conveniently secured to further hook and loop fastener strips on a remote portion of the covering surface. The pillow is provided with a hook and loop fastener strip selectively securable to a companion hook and loop fastener strip positioned on the mattress covering and selectively repositionable to further orientations relative to the mattress covering for use of a pillow subsequent to transport and thereby secure the pillow in a predetermined orientation to the covering during use.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved child's resting mat organization which has all the advantages of the prior art mat organizations and none of the disadvantages.

It is another object of the present invention to provide a new and improved child's resting mat organization which may be easily and efficiently manufactured and marketed.

It is a further object of the present invention to provide a new and improved child's resting mat organization which is of a durable and reliable construction.

An even further object of the present invention is to provide a new and improved child's resting mat organization which is susceptible of a low cost of manufacture with regard to both materials and labor, and which accordingly is then susceptible of low prices of sale to the consuming public, thereby making such child's resting mat organizations economically available to the buying public.

Still yet another object of the present invention is to provide a new and improved child's resting mat organization which provides in the apparatus and methods of the prior art some of the advantages thereof, while simultaneously overcoming some of the disadvantages normally associated therewith.

Still another object of the present invention is to provide a new and improved child's resting mat organization wherein the same is subject to ease of transport and subsequent selective use as desired.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
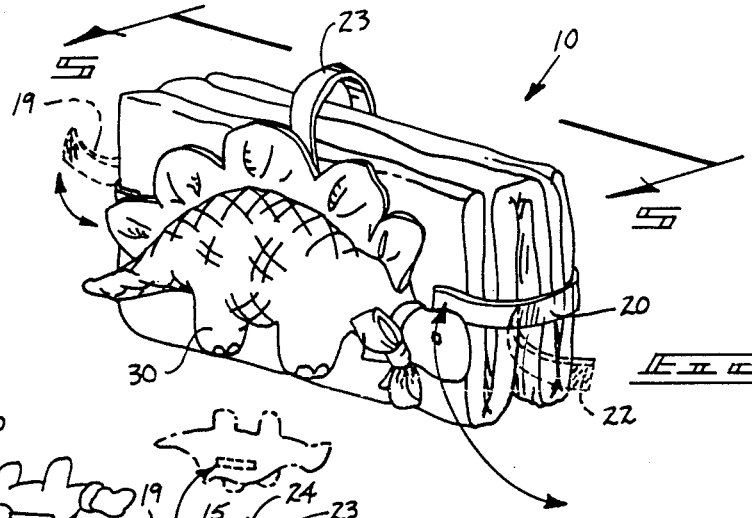
FIG. 1 is an isometric illustration of the instant invention in an interfolded relationship.

With reference now to the drawings, and in particular to FIGS. 1 to 5 thereof, a new and improved child's resting mat organization embodying the principles and concepts of the present invention and generally designated by the reference numeral 10 will be described.

Figure 2:
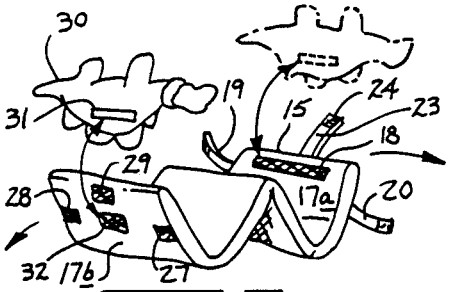
FIG. 2 is an isometric illustration of the instant invention in an intermediate stage subsequent to use.

More specifically, the child's resting mat organization 10 essentially comprises an elongate polymeric sponge foam mattress core 11 of a generally rectangular parallelepiped configuration, with a washable fabric covering 17 selectively securable thereover for sanitizing and cleansing of the covering as required. The mattress core 11 includes a first hook and loop fastener strip 13 positioned generally parallel to an upper edge of the core for cooperation, with a second hook and loop fastener strip 14 formed parallel to and adjacent an open terminal end edge 15 of the fabric covering 12 to enable securement of the covering relative to the core, with the second hook and loop fastener strip 14 positioned on an interior surface 16 of the covering, wherein an exterior covering surface 17 is formed with a third hook and loop fastener strip 18 coextensive with and overlying the second hook and loop fastener strip 14. The third hook and loop fastener strip 18 is positioned on the exterior covering surface 17. The exterior covering surface 17 is also defined by a forward surface **17*a* and a rear surface 17*b*, with the third hook and loop fastener strip 18 positioned on the forward strip, as illustrated in FIG. 2 for example. The fabric covering 12 is formed with a first and second securement strap 19 and 20 respectively that are fixedly mounted to the rear surface 17*b* in an aligned relationship relative to one another adjacent the open terminal end edge 15. The securement flaps 19 and 20 include respective first and second hook and loop fastener patches 21 and 22, wherein a third securement flap 23 is provided with a third hook and loop fastener patch 24. The third securement flap 23 is fixedly mounted to the fabric covering 12 extending orthogonally outwardly of the open terminal end edge 15 and fixedly mounted medially of the end edge 15 on the rear surface 17*b***.

Figure 5:
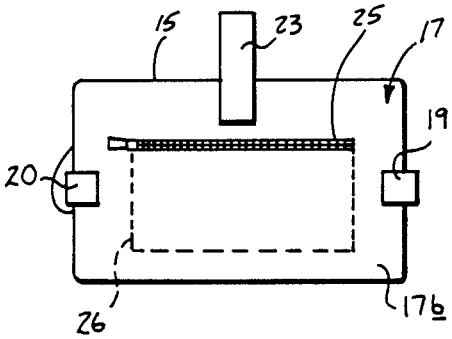
FIG. 5 is an orthographic view taken along the lines 5—5 of FIG. 1 in the direction indicated by the arrows.

Reference to FIG. 5 illustrates the third securement flap 23 with an underlying zippered opening 25 extending laterally of the covering adjacent the terminal end edge 15 providing access to a storage pouch 26.

Figure 3:
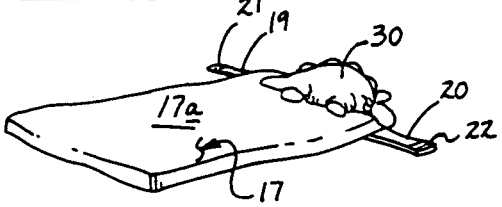
FIG. 3 is an isometric illustration of the instant invention extended for use.
Figure 4:
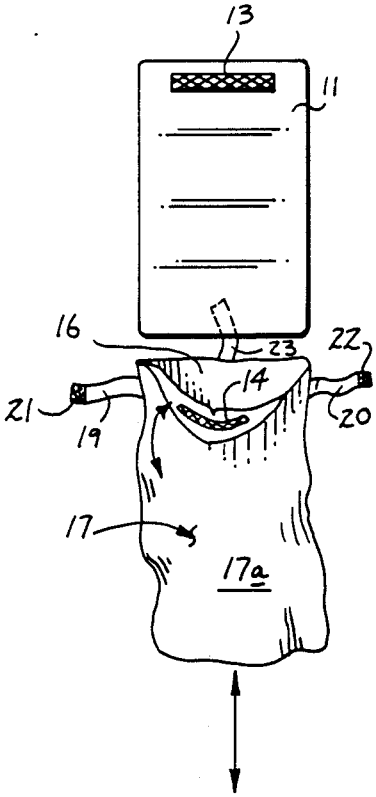
FIG. 4 is an isometric illustration of the instant invention, somewhat disassembled, to illustrate the association of the covering relative to the mattress core.

FIG. 2 is illustrative of aligned fourth and fifth hook and loop fastener strips 27 and 28 positioned adjacent opposed lateral side edges of the rear surface **17*b* adjacent the closed end 33 of the covering 12. The closed end further includes a sixth hook and loop fastener strip 29 positioned adjacent the edge spaced above the fourth and fifth hook and loop fastener strips 27 and 28, with an eighth hook and loop fastener strip 32 positioned medially of the fourth and fifth hook and loop fastener strips underlying the sixth hook and loop fastener strip 29, as illustrated in FIG. 2. A character designation pillow 30 is formed with a seventh hook and loop fastener strip 31 for securement selectively to the eighth hook and loop fastener strip 32 during transport of the organization, as illustrated in FIG. 1, or subsequent securement to the third hook and loop fastener strip 18 during use, as illustrated in FIG. 3. Securement of the organization in an accordion fashion is effected by the first and second securement securement flaps 19 and 20 and their respective first and second hook and loop fastener patches 21 and 22 extending about the interfolded sides of the mat organization, as illustrated in FIG. 1, and engaged to the respective fifth and fourth hook and loop fastener strips 28 and 27, as illustrated in FIG. 2**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A child's resting mat organization comprising:

an elongate flexible mattress core and a flexible fabric covering means for receiving the mattress core therein, and the covering means including an open upper end defined by a continuous upper edge and a closed lower end, and pillow means arranged for selective securement adjacent the close lower end of the covering means when the mattress core and covering means are in an accordion folded first position, and wherein the pillow means are securable adjacent the open upper end of the covering means when the mattress core and covering means are in an extended second position, and wherein a first hook and loop fastener strip is secured adjacent an upper end of the mattress core and cooperative with a second hook and loop fastener strip secured to an interior surface of the flexible covering adjacent the upper edge of the covering and positioned upon an interior surface of the covering, and a third hook and loop fastener strip coextensive with and overlying the second hook and loop fastener strip mounted on an exterior surface of the covering, wherein said third hook and loop fastener strip selectively receives the pillow means in the second position.

2. A child's resting mat organization as set forth in claim 1 including a first securement strap secured to a rear surface of the covering means extending exteriorly and laterally of an elongate side edge of the covering means, and a second securement flap aligned with the first securement flap extending outwardly of a second elongate side edge of the covering means, wherein the first and second securement straps include respective first and second hook and loop fastener patches thereon, and a fourth hook and loop fastener strip secured adjacent the closed end of the covering means aligned with a fifth hook and loop fastener strip adjacent the closed end of the covering means, wherein the fourth and fifth hook and loop fastener strips are positioned adjacent opposed side edges of the covering means and cooperative selectively with the first and second hook and loop fastener patches of the first and second securement flaps.

3. A child's resting mat organization as set forth in claim 2 including a third securement flap extending orthogonally relative to the continuous upper edge of the open end and provided with a third hook and loop fastener patch, and a sixth hook and loop fastener strip positioned above the fourth and fifth hook and loop fastener strips for securement with the third hook and loop fastener patch of the third securement flap, wherein the third securement flap defines a handle when secured to the sixth hook and loop fastener strip.

4. A child's resting mat organization as set forth in claim 3 including a seventh hook and loop fastener strip secured to a rear surface of the pillow means, and an eighth hook and loop fastener strip secured underlying the sixth hook and loop fastener strip and is spaced between the fourth and fifth hook and loop fastener strips for receiving the seventh hook and loop fastener strip when the mattress cover and covering means are in the first position, and wherein the seventh hook and loop fastener strip is securable to the third hook loop fastener strip when the mattress cover and covering means are in the second position.

5. A child's resting mat organization as set forth in claim 4 further including a pouch underlying the third securement flap on the rear surface of the covering means, and wherein the securement patch includes a zipper operative to selectively open and close access to the pouch.

* * * * *